US009259932B2

(12) United States Patent
White et al.

(10) Patent No.: US 9,259,932 B2
(45) Date of Patent: Feb. 16, 2016

(54) ASSEMBLY TO SELECTIVELY ETCH AT INKJET PRINTHEAD

(75) Inventors: Lawrence H. White, Corvallis, OR (US); Robel Vina, Corvallis, OR (US); Sara Jensen Homeijer, Corvallis, OR (US); Terry Mcmahon, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 824 days.

(21) Appl. No.: 13/117,745

(22) Filed: May 27, 2011

(65) Prior Publication Data

US 2012/0298622 A1 Nov. 29, 2012

(51) Int. Cl.
*B44C 1/22* (2006.01)
*B41J 2/16* (2006.01)

(52) U.S. Cl.
CPC ..... *B41J 2/1603* (2013.01); *B41J 2/1628* (2013.01); *B41J 2/1629* (2013.01); *B41J 2/1631* (2013.01); *B41J 2/1642* (2013.01); *B41J 2/1645* (2013.01); *B41J 2/1646* (2013.01); *Y10T 428/24612* (2013.01)

(58) Field of Classification Search
CPC .... B41J 2/14137; B41J 2/1601; B41J 2/1628; B41J 2/1629; B41J 2/1631; B41J 2/1639; B41J 2/1642; B41J 2/1646; Y10T 29/42; Y10T 29/49126; Y10T 29/49128; Y10T 29/4913; Y10T 29/49169; Y10T 29/49346; Y10T 29/49401
USPC ..... 216/2, 11, 13, 16, 17, 18, 27, 39, 41, 216/58, 67, 72, 75, 79, 99; 438/21, 384; 347/47, 50, 57, 59
See application file for complete search history.

(56) References Cited

U.S. PATENT DOCUMENTS

| | | | | |
|---|---|---|---|---|
| 6,325,488 | B1 | 12/2001 | Beerling et al. | |
| 6,439,703 | B1 | 8/2002 | Anagnostopoulos et al. | |
| 6,800,497 | B2 * | 10/2004 | Wang et al. | 438/21 |
| 6,866,943 | B2 * | 3/2005 | Friese et al. | 428/621 |
| 6,885,083 | B2 * | 4/2005 | Dodd et al. | 257/620 |
| 7,073,891 | B2 | 7/2006 | Shin et al. | |
| 7,089,665 | B2 * | 8/2006 | Chen et al. | 29/890.1 |
| 7,437,820 | B2 * | 10/2008 | Sexton et al. | 29/890.1 |
| 7,521,267 | B2 | 4/2009 | Dodd | |
| 7,713,456 | B2 * | 5/2010 | Dodd et al. | 264/139 |
| 7,837,887 | B2 * | 11/2010 | McReynolds et al. | 216/27 |
| 8,101,438 | B2 * | 1/2012 | McAvoy et al. | 438/21 |
| 8,164,185 | B2 * | 4/2012 | Cho et al. | 257/734 |
| 2003/0036279 | A1 * | 2/2003 | Dodd | 438/700 |
| 2008/0053954 | A1 * | 3/2008 | Silverbrook | 216/27 |
| 2011/0020965 | A1 | 1/2011 | McAvoy et al. | |

* cited by examiner

*Primary Examiner* — Nadine Norton
*Assistant Examiner* — Christopher Remavege
(74) *Attorney, Agent, or Firm* — Thorpe North & Western LP

(57) ABSTRACT

An assembly for selectively etching an inkjet printhead includes a substrate and printhead layers formed on the substrate. A bonding region can provide a location on the printhead layers for an electrical bond. An ink channeling region can be defined at least in part by the printhead layers. A mask layer can partially cover the printhead layers and include a first opening positioned over the bonding region and a second opening positioned over the ink channeling region. The assembly can also include a via at the first opening and a trench at the second opening having greater depth than the via.

1 Claim, 6 Drawing Sheets

ASSEMBLY TO SELECTIVELY ETCH AT INKJET PRINTHEAD

BACKGROUND

An inkjet printer typically includes one or more cartridges that contain ink. In some designs, the cartridge has discrete reservoirs of more than one color of ink. Each reservoir is connected via a conduit to a printhead that is mounted to the body of the cartridge. The reservoir may be carried by the cartridge or mounted in the printer and connected by a flexible conduit to the cartridge. The printhead is controlled for ejecting minute drops of ink from the printhead to a printing medium, such as paper, that is advanced through the printer.

The mechanism for expelling ink drops from each ink chamber (known as a "drop generator") includes a heat transducer, which typically comprises a thin-film resistor. The resistor is carried on an insulated substrate, such as a silicon die. The resistor material layer is covered with suitable passivation and cavitation-protection layers. The resistor has conductive traces attached thereto so that the resistor can be driven (heated) with pulses of electrical current. The heat from the resistor can form a vapor bubble in each ink chamber. Rapid expansion of the bubble propels an ink drop through the nozzle that is adjacent to the ink chamber.

Many of the components of the drop generators are fabricated or processed in ways that include photoimaging and other etch processing techniques similar to those used in semiconductor device manufacturing. The components are typically incorporated into and carried on a front surface of a rigid silicon substrate. The front surface of the substrate can also be shaped by etching to form a trench in that surface. The trench is later connected with a slot that is cut through the back of the substrate so that liquid ink may flow from the reservoir, through the connected slot and trench, and to the individual drop generators.

The trench that is etched in the substrate surface is located adjacent to the drop generator components. Also, the silicon etching that forms the trenches typically takes place after some or all of the drop generator components have been added to the substrate. Care may be taken when etching the trenches so as to not damage drop generator components. For example, the portion of the silicon substrate that is etched may be carefully defined on the substrate by masking the area to be etched with material that resists the effects of the etchant that is used for etching the trenches in the silicon. Despite efforts to efficiently form the trench and the drop generator components on the substrate, greater efficiencies can lead to additional cost and time savings.

DETAILED DESCRIPTION

Reference will now be made to the examples illustrated herein, and specific language will be used to describe the same. It will nevertheless be understood that no limitation of the scope of the technology is thereby intended. Additional features and advantages of the technology will be apparent from the detailed description which follows, taken in conjunction with the accompanying drawings, which together illustrate, by way of example, features of the technology.

Figure 1:
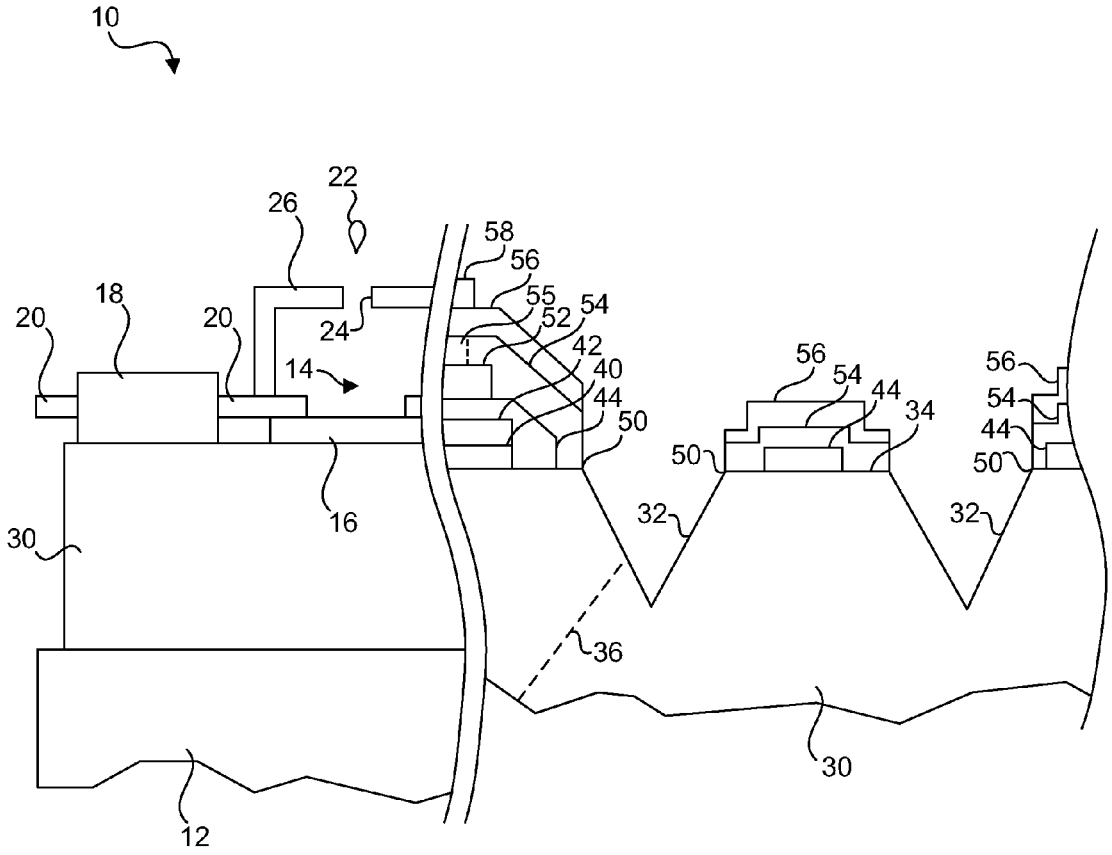
FIGS. 1-2 are cross-sectional side views of portions of thermal inkjet printhead assemblies in accordance with examples of the present technology.

Referring to FIG. 1, an illustration of some components of a thermal inkjet printhead 10 that is connected to a cartridge 12 that supplies ink to the printhead is shown. Many features of the printhead are not shown, as illustrated by a pair of curved lines in the center of the FIG. indicating intervening structure that is not shown.

The printhead 10 includes a number of ink chambers 14 (one of which is shown in FIG. 1) that hold a small volume of ink adjacent to a heat transducer 16. The heat transducer primarily comprises a thin-film resistor covered with protective layers as described more fully below. The transducer is supplied with current pulses that are controlled in part by a transistor 18 that is incorporated into the printhead.

Current pulses are conducted to the transistor 18 (and resistor) via a patterned layer of electrically conductive material 20. The current applied to the transducer 16 causes the resistor to heat instantaneously to a temperature that is sufficient for vaporizing some of the ink in the chamber 14. The rapid growth of the vapor bubble in the chamber expels a tiny ink drop 22 through one of the nozzles 24 of an orifice plate 26 that covers that part of the printhead. Each chamber has a single nozzle associated therewith.

The mechanism for expelling an ink drop as just explained can be characterized as "firing" an ink drop. In a typical printhead, multiple ink chambers are fired at a high frequency to produce a multitude of drops that are captured on media to form an image. The combination of components employed for firing a drop can be characterized as a drop generator. The drop generator is incorporated onto a die of a silicon wafer, which die forms a substrate 30 of the printhead 10. The substrate provides a rigid, planar member for supporting the remaining printhead components. In this example, the substrate is also doped to provide the source, gate, and drain elements of the transistor 18.

A thin, flexible circuit (not shown) is attached to the cartridge 12. The circuit may be a polyimide material that carries conductive traces. The traces connect to contact pads on the printhead for providing the current pulses though the conductive material 20 (gated through the transistor 18) under the control of a microprocessor that is carried in the printer with which the cartridge is used.

The transistor 18, conductive material 20, and transducer 16 each comprise selected combinations of layers of material that are deposited or grown on the substrate 30 using processes adapted from conventional semiconductor component fabrication. The right side of FIG. 1 is greatly enlarged for illustrating a portion of the layers of material remaining on the substrate 30 after completion of the drop generator.

The right side of FIG. 1 also shows a pair of trenches 32 that have been etched into the front surface 34 of the substrate 30. These trenches 32 will be in fluid communication with a slot 36 (shown by the pair of dashed lines in the substrate) that is later cut into the substrate (such as by abrasive jet machining, for example) from the back surface of the substrate. The resultant fluid communication between the slot and trenches permits the flow of ink from a reservoir carried in the cartridge 12, through the substrate, and over part of the front surface of the substrate to supply the ink chambers 14 described above.

Trenches 32 in the substrate surface 34 are etched by using a mask that precisely defines the trench area at the substrate surface and that protects the adjacent drop generator components from damaging exposure to the etchant. The mask is applied to the substrate to physically define the trenches. In one example, the mask can block contact between the etchant and other parts of the drop generators. As will be described in further detail below, this mask can also be used to form an electrical via 55 at substantially the same time.

In manufacturing the thermal inkjet printhead, a thin layer (about 1000 Angstroms, Å) of silicon dioxide 40 can grown on the front surface 34 of the substrate 30. This layer 40 can define the gate dielectric layer of the transistor 18 and may be referred to as a gate oxide layer or "GOX" layer 40. This oxide layer serves as dielectric for gate oxide capacitance and, when properly biased, an electric field can be produced which is responsible for channel formation. Accordingly, the oxide layer may also be referred to as a field oxide layer or "FOX" layer.

The FOX layer can be a dielectric material. A dielectric material for the field oxide, dielectric layer, and other electrical and/or thermal insulating layers can include tetraethyl orthosilicate (TEOS or $Si(OC_2H_5)_4$), silicon dioxide ($SiO_2$), undoped silicate glass (USG), phospho-silicate glass (PSG), boro-silicate glass (BSG), and boro-phospho-silicate glass (BPSG), $Al_2O_3$, $HfO_3$, SiC, SiN, or combination of these materials. The field oxide layer can be grown from a silicon substrate or created from oxidation of the silicon substrate.

The silicon substrate may be doped or implanted with elements like boron (B), phosphorous (P), arsenic (As) to change the silicon's electrical properties and may be used to create regions or wells that can be used to create pn junctions used for diodes and transistors. The elements or dopants may be used to change the electrical properties affecting current flow and direction of current flow. The elements or dopants may be deposited on the surface of the wafer by an ion implantation process. The dopants may be selectively applied to the silicon using a mask or an implant mask and may create an implanted doped layer (not shown). The mask may be applied using photolithography. The dopants may be absorbed by the wafer and diffused through the silicon using a heat, thermal, annealing, or rapid thermal annealing (RTA) process.

Above the FOX layer 40 there is deposited a 1000 Å layer, by way of example, of polysilicon 42, which can be applied using a low-pressure chemical vapor deposition (LPCVD) process with, for example, $SiH_4$ as a reactant gas to deposit the layer at 620° C. The polysilicon layer can be an electrically conductive layer similar to other metal or conductive layers included in the device. Some example metal or conductive layers can include platinum (Pt), copper (Cu) with an inserted diffusion barrier, aluminum (Al), tungsten (W), titanium (Ti), molybdenum (Mo), palladium (Pd), tantalum (Ta), nickel (Ni), or combination. The metal layer may have a thermal conductivity (K) greater than 20 W/(m·K) for temperature range from 25° C. to 127° C.

The FOX layer 40 and polysilicon layer 42 can be etched away in the area of the substrate surface 34 where the above-mentioned trenches 32 are to be formed (for convenience, this area is hereafter referred to as the trench area). In this regard, the process steps for fabrication of the drop generator components associated with this substrate (that is, the components diagrammed on the left side of FIG. 8) can include the use of a photoresist layer and photolithographic mask ("photomask") to define the gate region of the transistor 18. An area of the FOX and polysilicon layer remains to form part of the transistor gate.

The substrate 30 can be doped in conventional fashion to define the gate, source, and drain of the transistor 18. A layer of phosphosilicate glass (PSG) can be deposited using plasma-enhanced chemical vapor deposition (PECVD). The PSG layer 44 can be about 8000 Å thick (the layers not being shown to scale in the figures), by way of example. The PSG layer can serve as a dielectric layer for isolating the transistor gate, source, and drain on the substrate.

The PSG layer 44 can be patterned and etched at the same time (using the same photomask) that the PSG is also patterned and etched in the drop generator area to provide openings where a subsequently deposited metal layer can contact the transistor source, drain and gate, as well as the substrate. The PSG etching may be carried out using, for example, a combination of CF4, CHF3 and Ar.

The silicon substrate front surface 34 can be etched to define one or more trenches 32 (FIG. 1 illustrates an example including multiple trenches). The PSG 44 can be patterned so that the edges completely cover the FOX 40 and polysilicon 42 layers and extend into contact with the substrate surface 34, close to where the trench boundaries 50 are to be defined. The trench boundaries are the junctions of the trenches with the front surface 34 of the substrate.

A layer of metal 52 is deposited over the PSG layer 44, patterned using a photomask, and later etched for the purpose of providing the resistive and conductive material for the heat transducer 16 and conductive layer 20, respectively. In one example, the metal can include a plurality of metals which can be deposited in a sequence using a same metal deposition tool. For example, the plurality of metals can include a resistive material, such as TaAl or WSiN (about 900 Å thick) and a conductive material comprising AlCu (about 9000 Å thick).

Deposition of a layer of passivation material 54 can cover and protect the resistor of the heat transducer 16 from corrosion and other deleterious effects that might occur if the resistor were exposed to ink. The passivation material may be made up of a deposit of SiN (between about 1,500-2,500 Å, for example) covered with a deposit of SiC (between about 800-1,300 Å, for example). A conventional PECVD (plasma-enhanced chemical vapor deposition) reactor may be employed for this deposition.

Photomask and etching process steps applied to the passivation layer 54 can include masking and etching some of the passivation material for the purpose of defining an opening or via 55 through the passivation layer 54. As mentioned above and further described below, the via can be masked and etched at substantially the same time as the trenches 32. The via can permit a later-deposited metal layer to contact the metal layer 52 underlying the passivation layer 54. This contact provides electrical connection of the drop generator components (transistor 18, conductor 20, and transducer 16) to electrical leads that connect with the printer multiprocessor.

A metal layer 56, such as Tantalum (Ta), for example, is deposited over the passivation layer 54. The metal layer can be extended to cover the passivation material layer at the boundaries 50 of the trenches 32. This extension of the metal layer provides a protective cover over the passivation layer. The shape of the metal layer is determined by masking and etching steps.

Layer 58 is another metal layer, such as gold (Au), for example, that is deposited for use with the drop generator components and is etched away except for locations where it serves as electrical contact pads in communication with metals layer 52.

In thermal inkjet printhead manufacture, and more broadly in semiconductor manufacture, a number of steps or processes taken during the manufacture is generally related to a cost of the manufacture. As a result, reduction in the number of steps or other simplification of the manufacturing process can save time and money. As can be appreciated from FIG. 1, a depth of the trench 32 and a depth of the via 55 can be substantially different. Furthermore, material etched in forming the trench are typically different than materials etched in forming the via. Different chemistries of etchants generally affect semiconductor materials differently and a particular etchant chemistry does not typically affect different semiconductor materials similarly. As a result of the differences in depth and the chemistries involved, vias and trenches have typically been separately etched in different steps using different processes. However, the present technology provides for selective etching of multiple regions of a semiconductor assembly, such as a thermal inkjet printhead, substantially simultaneously to different depths and through different materials. While the following discussion relates primarily to the simultaneous etching of a via and a trench, the principles described can be applied to any of a variety of different semiconductor structures for any of a variety of different applications.

Figure 2:
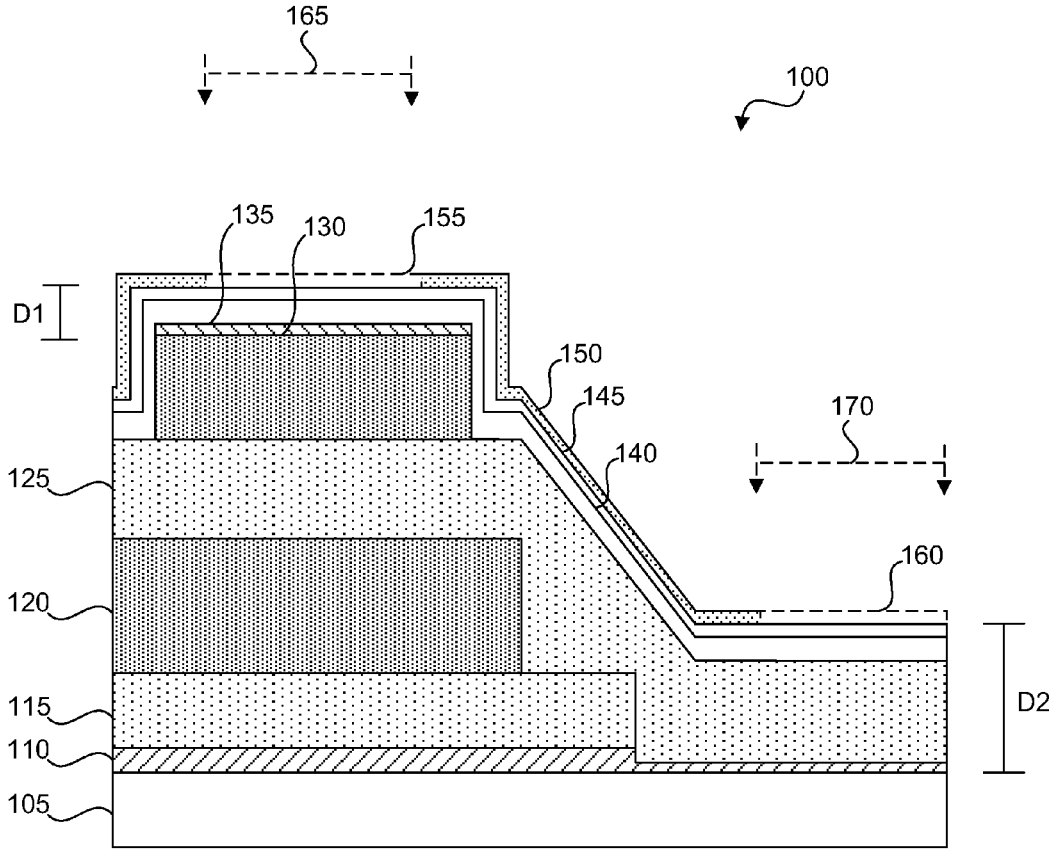

Referring to FIG. 2, a cross-sectional side view of a portion of an inkjet printhead assembly 100 is shown in accordance with an example of the present disclosure. As with FIG. 1, not all structures that may be present are necessarily shown, as the principles of the present disclosure are relevant to other similar structures. A variety of semiconductor materials are contemplated for use in the various layers of the assembly according to examples herein. Non-limiting examples of such semiconductor materials can include group IV materials, compounds and alloys comprised of materials from groups II and VI, compounds and alloys comprised of materials from groups III and V, and combinations thereof. More specifically, exemplary group IV materials can include silicon, carbon (e.g. diamond), germanium, and combinations thereof. Various exemplary combinations of group IV materials can include silicon carbide (SiC) and silicon germanium (SiGe). In one specific aspect, the semiconductor material can be or include silicon. Exemplary silicon materials can include amorphous silicon (a-Si), microcrystalline silicon, multicrystalline silicon, and monocrystalline silicon, as well as other crystal types. In another aspect, the semiconductor material can include at least one of silicon, carbon, germanium, aluminum nitride, gallium nitride, indium gallium arsenide, aluminum gallium arsenide, and combinations thereof.

Exemplary combinations of group II-VI materials can include cadmium selenide (CdSe), cadmium sulfide (CdS), cadmium telluride (CdTe), zinc oxide (ZnO), zinc selenide (ZnSe), zinc sulfide (ZnS), zinc telluride (ZnTe), cadmium zinc telluride (CdZnTe, CZT), mercury cadmium telluride (HgCdTe), mercury zinc telluride (HgZnTe), mercury zinc selenide (HgZnSe), and combinations thereof.

Exemplary combinations of group III-V materials can include aluminum antimonide (AlSb), aluminum arsenide (AlAs), aluminum nitride (AlN), aluminum phosphide (AlP), boron nitride (BN), boron phosphide (BP), boron arsenide (BAs), gallium antimonide (GaSb), gallium arsenide (GaAs), gallium nitride (GaN), gallium phosphide (GaP), indium antimonide (InSb), indium arsenide (InAs), indium nitride (InN), indium phosphide (InP), aluminum gallium arsenide (AlGaAs, AlxGa1-xAs), indium gallium arsenide (InGaAs, InxGa1-xAs), indium gallium phosphide (InGaP), aluminum indium arsenide (AlInAs), aluminum indium antimonide (AlInSb), gallium arsenide nitride (GaAsN), gallium arsenide phosphide (GaAsP), aluminum gallium nitride (AlGaN), aluminum gallium phosphide (AlGaP), indium gallium nitride (InGaN), indium arsenide antimonide (InAsSb), indium gallium antimonide (InGaSb), aluminum gallium indium phosphide (AlGaInP), aluminum gallium arsenide phosphide (AlGaAsP), indium gallium arsenide phosphide (InGaAsP), aluminum indium arsenide phosphide (AlInAsP), aluminum gallium arsenide nitride (AlGaAsN), indium gallium arsenide nitride (InGaAsN), indium aluminum arsenide nitride (InAlAsN), gallium arsenide antimonide nitride (GaAsSbN), gallium indium nitride arsenide antimonide (GaInNAsSb), gallium indium arsenide antimonide phosphide (GaInAsSbP), and combinations thereof.

The semiconductor materials of the present disclosure can also be made using a variety of manufacturing processes. In some cases the manufacturing procedures can affect the efficiency of the device, and may be taken into account in achieving a desired result. Exemplary manufacturing processes can include Czochralski (Cz) processes, magnetic Czochralski (mCz) processes, Float Zone (FZ) processes, epitaxial growth or deposition processes, and the like.

The various printhead layers 110, 115, 120, 125, 130, 135, 140, 145 of the assembly 100 can be formed using various deposition, etching, and/or lithography techniques. As specific and non-limiting examples of fabrication methods, various metal, dielectric, and other layers may be deposited using sputtering or evaporation processes, physical vapor deposition, chemical vapor deposition, electrochemical deposition, molecular beam epitaxy, and/or atomic layer deposition. Photolithography and masks may be used to pattern dopants and other layers. Photolithography may be used to protect or expose a pattern to etching which can remove material from the conductive or metal layer, the resistive layer, the dielectric layer, the passivation layer, the polymer layer, and other layers. Etching may include wet etching, dry etching, chemical-mechanical planarization (CMP), reactive-ion etching (RIE), deep reactive-ion etching (DRIE), etc. Etching may be isotropic or anisotropic. The resulting features from deposition and etching of layers can be resistors, capacitors, sensors, contact pads, wires, traces, and so forth that can connect devices and resistors together.

In one example, the printhead layers can include a plurality of dielectric layers 115, 125. The dielectric layers can include any of a variety of different dielectric materials individually or in combination. Some example dielectric layers include silicon, such as in silicon dioxide, tetraethyl orthosilicate (TEOS), silicate glass (including undoped silicate glass (USG), phospho-silicate glass (PSG), boro-silicate glass (BSG), and boro-phospho-silicate glass (BPSG)), silicon oxycarbide, silicon carbide, silicon nitride, and so forth. Some other examples include aluminum oxide and hafnium oxide. The dielectric layers may be selected according to a desired dielectric constant, typically between about 2.0 and 4.0.

The dielectric layers can provide electrical insulation to prevent shorting between layers. For example, the dielectric layer can provide thermal insulation to reduce heat dissipation from a thermal resistor to a thermally conductive first metal layer. The dielectric layer can reduce the effects of the first metal layer acting as a heat sink. The dielectric layer can have a thickness, thermal conductivity (K), and/or thermal diffusivity ($\alpha$) such that a turn on energy of thermal resistors is not excessive and can provide steady state heat accumulation and dissipation. Heat accumulation can be used to eject the ink or fluid from the ink chamber. Heat dissipation can allow the ink or fluid into the chamber after ejection of an fluid bubble. A steady state heat accumulation and dissipation can minimize vapor lock. Thermal diffusivity (with SI unit of $m^2/s$) for a material can be a thermal conductivity divided by the volumetric heat capacity represented by $$\alpha = \frac{k}{\rho c_p},$$

where $\rho_{c_p}$ is the volumetric heat capacity with the SI unit of $J/(m^3 \cdot K)$, $\rho$ is the density with the SI unit of $kg/m^3$, $c_p$ is the specific heat capacity with the SI unit of $J/(kg \cdot K)$, and K is the thermal conductivity with the SI units of $W/(m \cdot K)$. The thermal conductivity of the dielectric layer can be between 0.05 W/cm° K and 0.2 W/cm° K. The thermal diffusivity of the dielectric layer can be between 0.004 $cm^2$/sec and 0.25 $cm^2$/sec. When the dielectric layer is thin, excessive energy may be applied to create a drive bubble due to heat loss to the silicon substrate which can be an inefficient use of energy. When the layer is thick, heat can be trapped and eventually causes vapor lock in the ink jet chamber so the printhead does not function properly. Balanced thickness of the dielectric layer can improve ink bubble creation, heating, and delivery (or ejection). In some examples, the dielectric layer can have a thickness between 0.4 μm and 2 μm, or between 0.8 μm and 2 μm to provide sufficient thermal insulation between layers.

The printhead layers can also include a plurality of conductive layers 120, 130. For example, the conductive layers may comprise a metal material. The metal material can include a suitable material, such as aluminum, silver, or copper. In a specific example, the metal material includes a plurality of different metals, such as AlCu and TaAl, as described above in reference to FIG. 1. In another example, a conductive layer can be deposited as a blanket film of aluminum. The aluminum film can be patterned and etched to form one or more isolated wires as a trace for conducting an electrical current. For some applications, aluminum may result in timing delays and the trace can be formed of copper. Devices including copper traces can be formed using damascene processing, such as single or double damascene processing. In some examples damascene processing can eliminate one or more processing steps and provide certain efficiencies over processing of aluminum wires. In some examples, the conductive layers may be formed from a conductive non-metal material, such as Indium Tin Oxide (ITO), Transparent Conductive Oxide (TCO), a conductive polymer, or any other suitable conductive material. The metal layers can be deposited by a screen printing process or a variety of other known metal deposition processes.

The printhead assembly 100 includes an oxide layer OR FOX layer 110 over the substrate and which is formed to passivate and protect the semiconductor substrate surface outside of an active device region. A first dielectric layer 115 can be deposited over the FOX layer. For example, the first dielectric layer may include USG or BPSG. FIG. 2 illustrates a variation on the arrangement of the first dielectric layer and the FOX layer from the example shown in FIG. 1. Whereas the FOX layer in FIG. 1 was enclosed or completely covered by the dielectric layer, the FOX layer of FIG. 2 extends beyond the first dielectric layer and is not completely covered by the first dielectric layer. In one example, an etching step used to shape the first dielectric layer can etch at least a portion of the FOX layer. The FOX layer can be partially or completely etched away from an area not between the first dielectric layer and the substrate.

A first metal layer 120 can be deposited and patterned over the first dielectric layer 115, and a second dielectric layer 120, such as a TEOS layer, can be formed over the first metal layer. The second dielectric layer can extend over the first metal layer, a portion of the first dielectric layer not covered by the first metal layer, and the FOX layer 110 (or the substrate 105 if the FOX layer has been removed down to the substrate). A second metal layer 130 can be deposited and patterned over the second dielectric layer. Vias (not shown) can be patterned and formed through the dielectric material layers (i.e., the first dielectric layer and the second dielectric layer) for electrical connection between the metal layers and other components of the printhead assembly.

One or more passivation materials or layers 140, 145 can be deposited over the second metal layer 130. A resistor layer 135 can be included between the second metal layer and the passivation layers. The passivation materials can also extend over at least a portion of the second dielectric layer 125. The layers included in the figure include a layer of tungsten silicon nitride (WSiN) 135 deposited over the second metal layer, and passivation layers of silicon nitride (SiN) 140 and silicon carbide (SiC) 145 deposited over the WSiN layer and the TEOS layer 125.

The printhead assembly 100 thus described can include a bonding region 165 providing a location on the printhead layers for an electrical bond. This bonding region can include a location for formation of an electrical via for a subsequently deposited bond pad. Etching of the via can include etching through the passivation layers. A combined thickness of the passivation layers can approximate a depth D1 of an etch used to form a via. As will be described in further detail below, the etching process to form the via may etch a portion of the second metal layer as well, and thus the depth D1 of the etch may not be limited to a combined thickness of the passivation layers.

The printhead assembly 100 described can also include an ink channeling region 170 defined at least in part by the plurality of printhead layers. In other words, the arrangement, shape, ordering, structuring, etc. of the various printhead layers can define appropriate locations for etching a trench or a via, for example, in effect defining the ink channeling region and the bonding region. The ink channeling region can include a location for formation of a trench for channeling ink in a completed printhead. Etching of the trench can include etching through passivation layers present in the ink channeling region, the second dielectric layer, and the FOX layer (if present). A combined thickness of the passivation layers the second dielectric layer, and the FOX layer can approximate a depth D2 of an etch used to form the trench. D2 is generally a greater depth etch than D1. For example, D2 may be at least twice the depth of D1, or five, ten, twenty, or a hundred times or more the depth of D1. Thus, D2 may be one, two, or more orders of magnitude greater than D1.

The printhead assembly 100 can include a mask layer 150. The mask layer can partially cover the printhead layers. In one example, the mask layer can substantially completely cover the printhead layers with the exception of holes or openings in the mask for etching the via and trench. A first opening 155 can be positioned over the bonding region to form a via and a second opening 160 can be positioned over the ink channeling region to form a trench.

Figure 3:
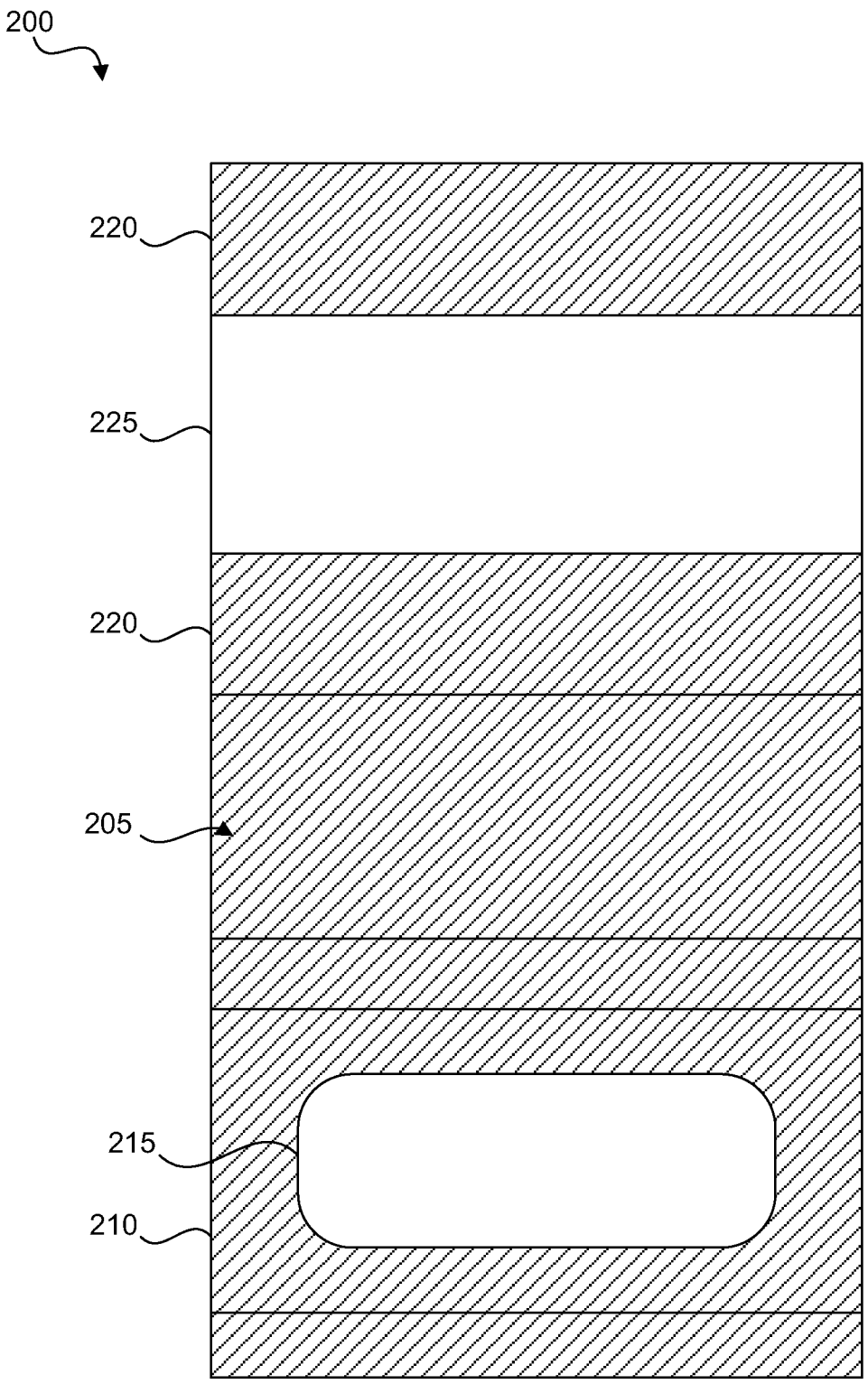
FIG. 3 is a top view of a portion of a masked thermal inkjet printhead assembly in accordance with an example of the present technology.

Referring to FIG. 3, a top view of a masked printhead assembly 200 is shown in accordance with an example of the present disclosure. A mask 205 is covering the printhead layers except through an opening 225 for forming a trench in the ink channeling region 220 and another opening 215 for forming a via in the bonding region 210. In one example, the opening for forming the via includes rounded corners such that the resultant via will also have rounded corners. Rounding of the corners can reduce stresses on layers formed in and/or around the via as well as reduce an amount of material used to fill in the via.

Figure 4:
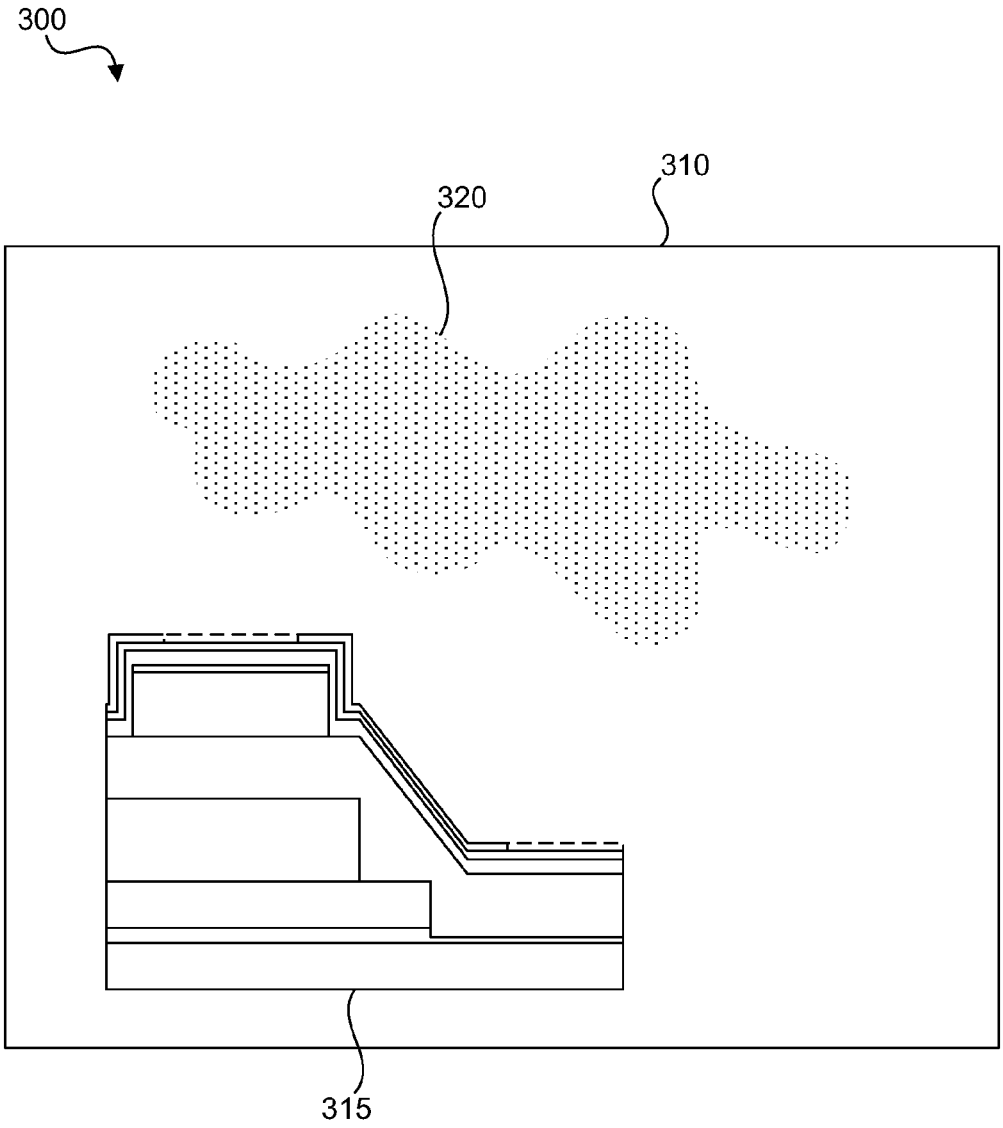
FIG. 4 is a side view of a system for manufacturing a thermal inkjet printhead in accordance with an example of the present technology.

Referring to FIG. 4, a system 300 for selectively etching an inkjet printhead is shown in accordance with an example of the present disclosure. The system includes a masked printhead assembly 315 (such as has been described with reference to FIGS. 2-3) and a plasma chamber 310 for etching the masked printhead assembly with an etchant material 320. The etchant material can be selected to etch a trench in the ink channeling region to a depth greater than a via in the bonding region. The etchant material in this example is a chemical vapor or gas which reacts with printhead layers exposed by the openings in the mask.

A specific example of the etching process for etching the printhead layers to the different depths and through the different semiconductor materials will now be described. This example is not intended to be limiting, but rather, describes a specific example of practicing that described in the present disclosure. This example contemplates an assembly including TEOS as the second dielectric layer, AlCu as the second metal layer, silicon (Si) as the substrate, a FOX layer over the substrate, and WSiN, SiN, and SiC as passivation layers. A thickness or depth differential for the trench etch versus the via etch is approximately 6:1. The etching process can include multiple steps.

In a first etching step, a combination of gasses or etchant flows includes 575 sccm of Ar, 90 sccm of $CF_4$, and 40 sccm of $O_2$. These gasses are applied to the masked printhead assembly in the plasma chamber at a pressure of approximately 425 mT and a power of approximately 720 W. This first etching step will etch through the SiC and SiN layers. This first etching step will also typically etch at least a portion of the WSiN layer.

In a second etching step, a combination of gasses includes 150 sccm of Ar, 200 sccm of $CF_4$, and 18 sccm of $CHF_3$. These gasses are applied to the masked printhead assembly in the plasma chamber at a pressure of approximately 1200 mT and a power of approximately 1250 W. This second etching step will etch any remainder of the WSiN layer and will substantially stop on the AlCu layer in the bonding region. This second etching step will also etch the TEOS and FOX layers in the ink channeling region.

A third etching step can be an overetch step to clear any remaining FOX in the ink channeling region and stop on the Si substrate. The etch is complete for the WSiN layer in the bonding region, so this etching step will continue to substantially stop on AlCu. A combination of gasses for the third etching step includes 150 sccm of Ar and 200 sccm of CF4. These gasses are applied to the masked printhead assembly in the plasma chamber at a pressure of approximately 1200 mT and a power of approximately 1250 W.

A summary of these three etching steps is shown in Table 1 below.

TABLE 1

| | | First Etch | Second Etch | Third Etch |
|---|---|---|---|---|
| Layer Etched? | SiC | Yes | No | No |
| | SiN | Yes | No | No |
| | WSiN | Yes | Yes | No |
| | TEOS | No | Yes | No |
| | FOX | No | Yes | Yes |
| | Si | No | No | No |
| Gas Amount (sccm) | Ar | 575 | 150 | 150 |
| | CF4 | 90 | 200 | 200 |
| | CHF3 | 0 | 18 | 0 |
| | O2 | 40 | 0 | 0 |
| Chamber Pressure (mT) | | 425 | 1200 | 1200 |
| Chamber Power (W) | | 720 | 1250 | 1250 |

A wide range of processing conditions may be used to perform the etching steps. Typically, the etching process may include use of a fluorine-containing etch gas with a carrier gas, such as Ar, for example. $O_2$ may also typically be included for etching SiC. Pressures, powers, times, etc. can vary.

In the example etching steps described, the Si substrate acts as a trench etching stop to stop the etching process in the ink channeling region. The etchant gases are not configured to etch through the Si material. One or more of the printhead layers disposed over the substrate can also act as an etching stop in the bonding region. Specifically, for the example given, the etchant gases are not configured to etch through the AlCu material. While the gases may not be configured to etch through the AlCu material, a small amount of the AlCu material may yet be etched because of the continued exposure to the gasses while the thicker TEOS layer is etched. While the AlCu material substantially stops the etching in the bonding region, the WSiN layer can act as an etch retardant to slow the etching process in the bonding region as compared with the etching process in the ink channeling region. Retarding the etching process in the bonding region can allow more of the TEOS layer in the ink channeling region to be etched before the AlCu layer is reached in the bonding reaching, thus reducing the effects of the etching process on the AlCu layer.

As has been described, a thickness of the layers etched in the ink channeling region to form the trench may be generally greater than a thickness of the layers etched in the bonding region to form the via. The masked printhead assembly can include etching stops or etch resistant layers at appropriate depths to enable etching through the desired layers and stopping at a desired depth within the layers. For example, a trench etching stop (i.e., the Si substrate) is positioned at a greater depth with respect to an uppermost layer of the masked assembly in the ink channeling region than a via etching stop (i.e., the AlCu layer) is with respect to an uppermost layer of masked assembly in the bonding region.

Figure 5:
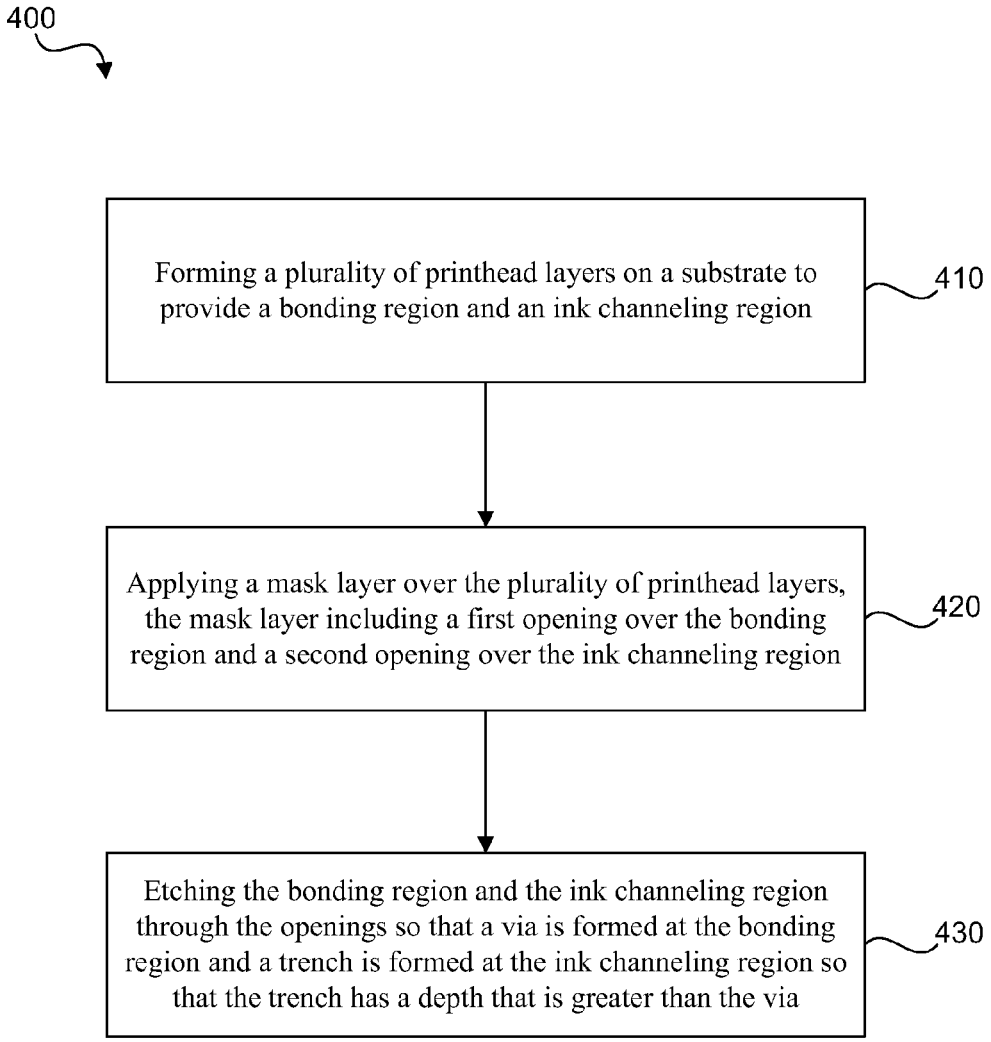
FIG. 5 is a flow diagram of a method for manufacturing a thermal inkjet printhead in in accordance with an example of the present technology.

Referring to FIG. 5, a flow diagram of a method 400 for manufacturing an inkjet printhead is illustrated in accordance with an example. The method includes forming 410 a plurality of printhead layers on a substrate to provide a bonding region and an ink channeling region. A mask layer can be applied 420 over the plurality of printhead layers and include a first opening over the bonding region and a second opening over the ink channeling region. The bonding region and the ink channeling region can then be etched 430 through the openings so that a via is formed at the bonding region and a trench is formed at the ink channeling region such that the trench has a depth that is greater than the via. Etching the bonding region and the ink channeling region can include substantially simultaneously etching through at least one material at the bonding region and at least one different material at the ink channeling region. For example, the WSiN layer can be etched in the bonding region while the TEOS layer is etched in the ink channeling region. As another example, a small portion of the AlCu layer can be etched in the bonding region while the TEOS layer and/or the FOX layer is/are etched in the ink channeling region.

The method can also include ceasing etching of the bonding region and the ink channeling region on different materials. The different materials on which etching is ceased can include, for example, the substrate and the materials included in the plurality of printhead layers. As a specific example, etching can cease on a conductive layer in the bonding region and on the substrate in the ink channeling region.

As has been described, a layer, such as the WSiN layer, can be included to retard the etching process in the bonding region. Any of a variety of different materials may be used as an etch stop or etch retardant. A specific material may depend on a chemistry of the etchant and what other materials are included in the printhead layers. Some other example materials for certain applications may include Ti or poly-silicon.

The method can therefore include impeding etching of the bonding region before etching of the trench is completed. Similarly, the method can include retarding etching at the bonding region while continuing to etch the trench in the ink channeling region. The steps of impeding or retarding the etching can include selecting a combination of etchants that etch a material used as the etch retardant layer more slowly.

In a more specific example related to the example shown in Table 1 above, the steps of etching the bonding region and the ink channeling region can also include etching a passivation layer through the openings in the bonding region and the ink channeling region using a first combination of etchant materials at a first pressure and a first power level, followed by etching an etching retardant layer in the bonding region and a dielectric layer in the plurality of layers in the ink channeling region using a second combination of etchant materials at a second pressure and a second power level, and continuing etching the dielectric layer using a third combination of etchant materials at the second pressure and the second power level.

Figure 6:
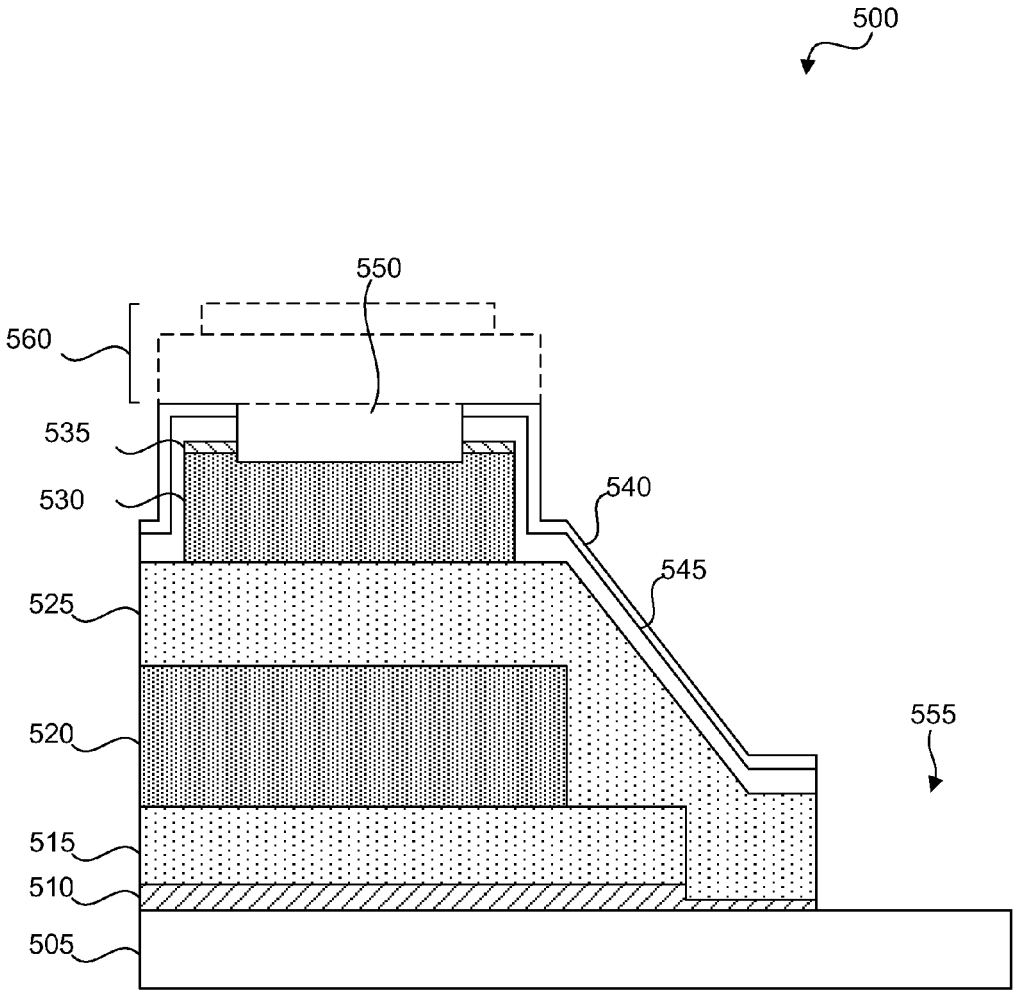
FIG. 6 is a cross-sectional side view of a portion of thermal inkjet printhead assembly in accordance with an example of the present technology.

Referring to FIG. 6, an inkjet printhead assembly 500 is illustrated after etching in the bonding region and the ink channeling region is completed. The assembly includes a substrate 505 and printhead layers 510, 515, 520, 525, 530, 535, 540, 545 formed over the substrate, including both dielectric (i.e., 515, 525) and conductive (i.e., 520, 530) layers. The assembly includes a bonding region providing a location on the printhead layers for an electrical bond. The bonding region includes an electrical via 550 for connecting at least one of the conductive layers with a (not yet deposited) bond pad 560. The assembly includes an ink channeling region defined at least in part by the printhead layers. At least one of the printhead layers (i.e., layer 530) can be an etching stop to form a base of the via and the substrate 505 can be an etching stop to form a base of the trench 555.

The assembly 500 can also include a mask layer partially covering the printhead layers and having a first opening positioned over the bonding region and a second opening positioned over the ink channeling region. The via 550 can be formed at the first opening and extend through passivation layers 540, 545 and an etch retardant layer 535. The trench 555 can be formed at the second opening and can extend through the printhead layers to the substrate 505. A depth of the trench, as measured from an uppermost surface of the printhead layers in the ink channeling region to an upper surface of the substrate, can be greater than a depth of the via, as measured from an uppermost surface of the printhead layers in the bonding region to an upper surface of a conductive layer closest to the uppermost surface of the printhead layers in the bonding region. After the via and the trench are etched, the mask layer can be removed, as shown in the figure.

The foregoing descriptions and illustrations are simplified for purposes of explanation. A printhead assembly can include a variety of other layers and configurations as well. Some non-limiting example layers follow.

An adhesion layer can be deposited on the substrate or on one or more of the printhead layers. Some elements and compounds, such as gold, used in fabrication may not adhere well to the substrate or other layers on the substrate. An adhesion layer can be used to adhere or join one layer to another. As examples, the adhesion layer can be used to join a bond pad layer to a passivation layer, a metal layer, a resistive layer, a dielectric layer, or the substrate.

The bond pad 560 to be deposited over the via can include one or more layers, such as a layer of tantalum and a layer of gold. In an example, one or more layers of the bond pad can be between approximately 0.1 μm and 0.5 μm thick individually or in combination. 1 μm of gold can have a sheet resistance of approximately 28 mΩ/square. The bond pad layer can have a sheet resistance between 56 mΩ/square and 280 mΩ/square. A bond pad on the printhead assembly can be used to provide electrical contacts or connections from circuits on the printhead assembly to leads on a semiconductor chip packaging. The bond pad can include photoresist, SU-8 molecules, polymer, epoxy, or combination.

Polymer layers can also be deposited on the substrate. For example, the polymer layers can include a polymer primer layer, a polymer chamber layer, and a polymer top hat layer. A thermal inkjet ink chamber can be formed in a polymer layer or plurality of polymer layers used in a thermal ink jet printhead. The layers can be formed to create fluid flow channels and/or a trough in the thermal inkjet chamber with a thermal resistor.

Although the foregoing description has focused on the production of mechanisms suitable for inkjet printing, it will be appreciated that the present disclosure may also be applied to the production of drop generators for any of a variety of applications, such as aerosols that are suitable for pulmonary delivery of medicine, scent delivery, dispensing precisely controlled amounts of pesticides, paints, fuels, etc.

While the forgoing examples are illustrative of the principles of the present technology in one or more particular applications, it will be apparent to those of ordinary skill in the art that numerous modifications in form, usage and details of implementation can be made without the exercise of inventive faculty, and without departing from the principles and concepts of the technology. Accordingly, it is not intended that the technology be limited, except as by the claims set forth below.

What is claimed is:

1. A method of manufacturing an inkjet printhead, comprising:

forming a plurality of printhead layers on a substrate to provide a bonding region and an ink channeling region;

applying a mask layer over the plurality of printhead layers, the mask layer including a first opening over the bonding region and a second opening over the ink channeling region; and etching the bonding region and the ink channeling region through the openings so that a via is formed at the bonding region and multiple layers of the plurality of printhead layers are etched through the second opening to form a trench at the ink channeling region and so that the trench has a depth that is greater than the via, wherein etching the bonding region and the ink channeling region further comprises:

etching a passivation layer through the openings in the bonding region and the ink channeling region using a first combination of etchant materials at a first pressure and a first power level;

etching an etching retardant layer in the bonding region and a dielectric layer in the plurality of layers in the ink channeling region using a second combination of etchant materials at a second pressure and a second power level; and continuing etching the dielectric layer using a third combination of etchant materials at the second pressure and the second power level.

* * * * *